US008259971B2

(12) United States Patent
Büttner et al.

(10) Patent No.: US 8,259,971 B2
(45) Date of Patent: Sep. 4, 2012

(54) HEARING APPARATUS WITH CONTROLLED PROGRAMMING SOCKET

(75) Inventors: Reiner Büttner, Forchheim (DE); Thomas Kasztelan, Berlin (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 669 days.

(21) Appl. No.: 12/291,686

(22) Filed: Nov. 12, 2008

(65) Prior Publication Data

US 2009/0129614 A1 May 21, 2009

(30) Foreign Application Priority Data

Nov. 15, 2007 (DE) ..... 10 2007 054 603

(51) Int. Cl.
*H04R 25/00* (2006.01)

(52) U.S. Cl. ..... 381/314; 381/23.1; 381/312; 381/313; 381/323

(58) Field of Classification Search ..... 381/23.1, 381/312–314, 323
See application file for complete search history.

(56) References Cited

U.S. PATENT DOCUMENTS

| | | | | |
|---|---|---|---|---|
| 4,049,930 | A * | 9/1977 | Fletcher et al. | 381/60 |
| 4,972,487 | A * | 11/1990 | Mangold et al. | 381/315 |
| 4,995,085 | A * | 2/1991 | Kern et al. | 381/320 |
| 5,404,407 | A * | 4/1995 | Weiss | 381/314 |
| 5,581,747 | A * | 12/1996 | Anderson | 713/400 |
| 5,600,728 | A * | 2/1997 | Satre | 381/314 |
| 5,602,925 | A * | 2/1997 | Killion | 381/312 |
| 5,659,621 | A * | 8/1997 | Newton | 381/312 |
| 6,456,199 | B1 * | 9/2002 | Michael | 340/573.1 |
| 6,785,394 | B1 * | 8/2004 | Olsen et al. | 381/312 |
| 6,839,447 | B2 * | 1/2005 | Nielsen et al. | 381/312 |
| 7,292,876 | B2 * | 11/2007 | Bosch et al. | 455/556.1 |
| 7,496,206 | B2 * | 2/2009 | Husung | 381/312 |
| 7,623,667 | B2 * | 11/2009 | Sander et al. | 381/74 |
| 7,974,716 | B2 * | 7/2011 | Schumaier | 700/94 |
| 2001/0033664 | A1 * | 10/2001 | Poux et al. | 381/60 |
| 2002/0191806 | A1 * | 12/2002 | Rohrseitz et al. | 381/323 |
| 2003/0128855 | A1 * | 7/2003 | Moller | 381/314 |
| 2003/0156727 | A1 * | 8/2003 | Vonlanthen | 381/330 |
| 2004/0037442 | A1 * | 2/2004 | Nielsen et al. | 381/315 |
| 2004/0202340 | A1 * | 10/2004 | Armstrong et al. | 381/312 |
| 2005/0196002 | A1 * | 9/2005 | Hagen et al. | 381/314 |
| 2007/0047749 | A1 * | 3/2007 | Kasztelan et al. | 381/315 |
| 2009/0074215 | A1 * | 3/2009 | Schumaier | 381/314 |
| 2009/0180643 | A1 * | 7/2009 | Sander et al. | 381/111 |
| 2010/0008526 | A1 * | 1/2010 | De Vries et al. | 381/314 |
| 2010/0020992 | A1 * | 1/2010 | Flynn | 381/314 |
| 2010/0040247 | A1 * | 2/2010 | Ypma et al. | 381/314 |

(Continued)

FOREIGN PATENT DOCUMENTS

DE 4031132 A1 8/1991

(Continued)

*Primary Examiner* — Eugene Lee
*Assistant Examiner* — Mohammed Shamsuzzaman

(57) ABSTRACT

A Hearing apparatuses is provided. The hearing apparatus includes a programming socket that features at least a first connection and a second connection, with a signal processing system that is connected to the second connection, and with a control system. The control system taps the potential of the first connection. The control system furthermore engages the signal processing system in a first function when the first connection reaches the predetermined potential and in a second function when the potential of the first connection deviates from the predetermined potential. This enables multiple usages for example of the input of a programming interface of a signal processing IC.

13 Claims, 3 Drawing Sheets

U.S. PATENT DOCUMENTS

| | | | | |
|---|---|---|---|---|
| 2010/0067722 | A1* | 3/2010 | Bisgaard | 381/314 |
| 2010/0086153 | A1* | 4/2010 | Hagen et al. | 381/314 |
| 2010/0246865 | A1* | 9/2010 | Suurballe | 381/314 |
| 2010/0260363 | A1* | 10/2010 | Glatt et al. | 381/312 |

FOREIGN PATENT DOCUMENTS

| | | | |
|---|---|---|---|
| DE | 4233813 | C1 | 11/1993 |
| DE | 102006024713 | B3 | 8/2007 |

* cited by examiner

HEARING APPARATUS WITH CONTROLLED PROGRAMMING SOCKET

CROSS REFERENCE TO RELATED APPLICATIONS

This application claims priority of German application No. 10 2007 054 603.5 DE filed Nov. 15, 2007, which is incorporated by reference herein in its entirety.

FIELD OF INVENTION

The present invention relates to a hearing apparatus having a programming socket that features at least a first connection and a second connection, having a signal processing system that is connected to the second connection, and having a control system. The term "hearing apparatus" is understood here to mean any sound-emitting device that can be worn on or in the ear, in particular a hearing device, a headset, a set of ear phones and the like.

BACKGROUND OF INVENTION

Hearing devices are wearable hearing apparatuses which are used to assist the hard-of-hearing. In order to accommodate numerous individual requirements, various types of hearing devices are available such as behind-the-ear (BTE) hearing devices, hearing device with external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

SUMMARY OF INVENTION

Hearing devices are frequently fitted with a programming socket that enables the hearing device to be programmed individually. Two connections are typically provided for this purpose on the hearing device's signal processing chip, which contains the programming interface. The signal processing chip additionally has to process numerous other input signals, and therefore a correspondingly large number of inputs and/or connections is provided. The more functions that are implemented in a hearing device, the more connections are to be provided, which can however eventually lead to space problems.

Programming of a hearing device takes place when it is first fitted and possibly again in a subsequent adjustment session or in the event of a software update. However there are relatively few such events during the total period in which the hearing device is in use. However both a programming socket and generally also two chip connections are retained for programming purposes.

The object of the present invention is to make optimal use of the available space in a hearing apparatus and/or to make the hearing apparatus accordingly smaller.

This object is achieved in accordance with the invention by means of a hearing apparatus having a programming socket that features at least a first connection and a second connection, having a signal processing system that is connected to the second connection, and having a control system, with the control system tapping the potential of the first connection and with the control system engaging the signal processing system in a first function when the first connection reaches the predetermined potential and in a second function when the potential of the first connection deviates from the predetermined potential.

Through the inventive multiple usage of a connection of a programming socket and/or of the associated chip connection it is possible to save space for additional functional units.

The programming socket preferably has a third connection that is set to a fixed internal potential of the hearing apparatus, with a coupling element being removably inserted on the one hand into the third connection and on the other hand into the first connection, by which means the predetermined potential is formed by the fixed internal potential. By this method it is easily possible to program a connection of the programming socket with a signal through which the control system can deduce that the second connection is being used for a function that differs from its normal function.

The fixed internal potential can be for example ground or a supply voltage. Both potentials typically each lie against a connection of the programming socket so that one of them can be transferred to the third connection for example with the aid of a simple electrical circuit as a coupling element. The third connection can alternatively also be conducted to ground or to the supply voltage in the programming socket for example with the aid of an ohmic resistor as a coupling element. Thus a characteristic voltage that uniquely indicates a special function of the second connection can be configured at the third connection.

According to a particularly preferred embodiment a button is attached to the second connection. Consequently the programming input can also be used for a user interface. In particular a button system, which contains the button and the coupling element with which the first connection is set to a specific potential, can be mounted on the programming socket. The button system thus requires no dedicated space on the surface of the hearing apparatus and simultaneously serves to protect the programming socket.

The first connection can be used especially for synchronization and the second connection for data input when programming the hearing apparatus. The synchronization connection is therefore then used for connection programming and the data input connection for analog signal input for example.

BRIEF DESCRIPTION OF THE DRAWINGS

The present invention is described in more detail with reference to the appended drawings, in which.

DETAILED DESCRIPTION OF INVENTION

The exemplary embodiments shown in more detail below represent preferred embodiments of the present invention.

Figure 1:
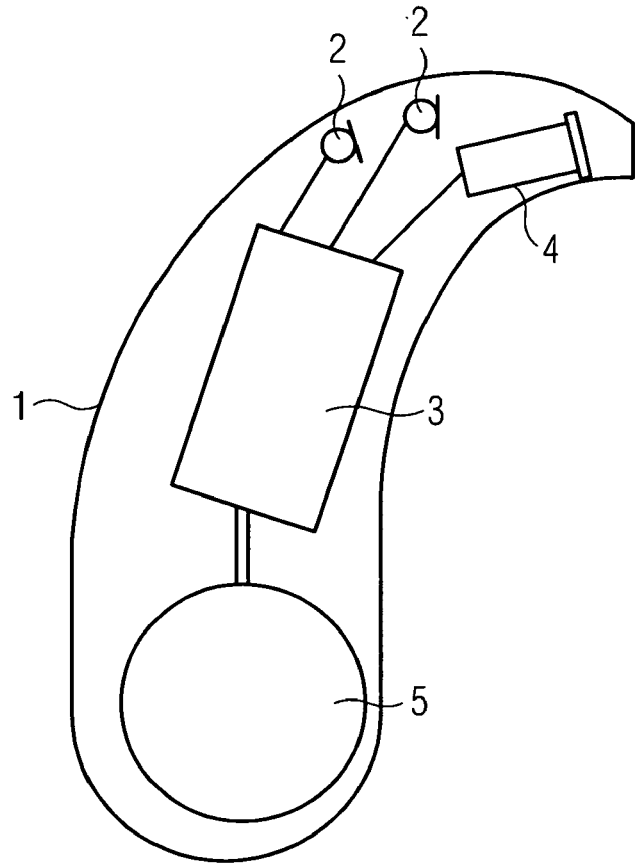
FIG 1 (Prior art)
FIG. 1 shows the basic design of a hearing device according to the prior art.
Figure 2:
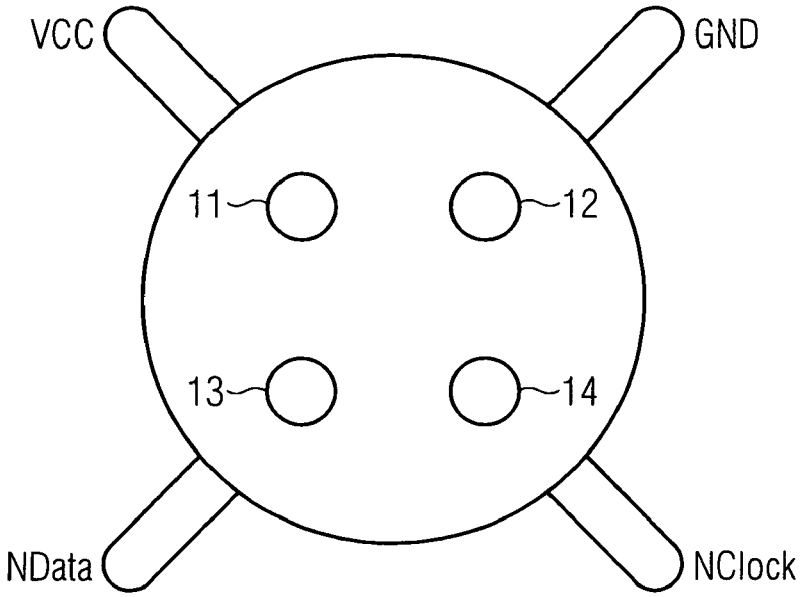
FIG 2 (Prior art)
FIG. 2 shows a plan view of a programming socket according to the prior art.

In order to describe the invention in more detail FIG. 2 shows a plan view of a programming socket, which generally has four contacts 11 to 14. The corresponding solder tails are also visible in the plan view. In the example chosen the first contact 11 acts as a VCC connection, the second contact 12 as a ground connection, the third contact 13 is used for data transmission (NData) and the fourth connection 14 for synchronization (NClock).

Figure 3:
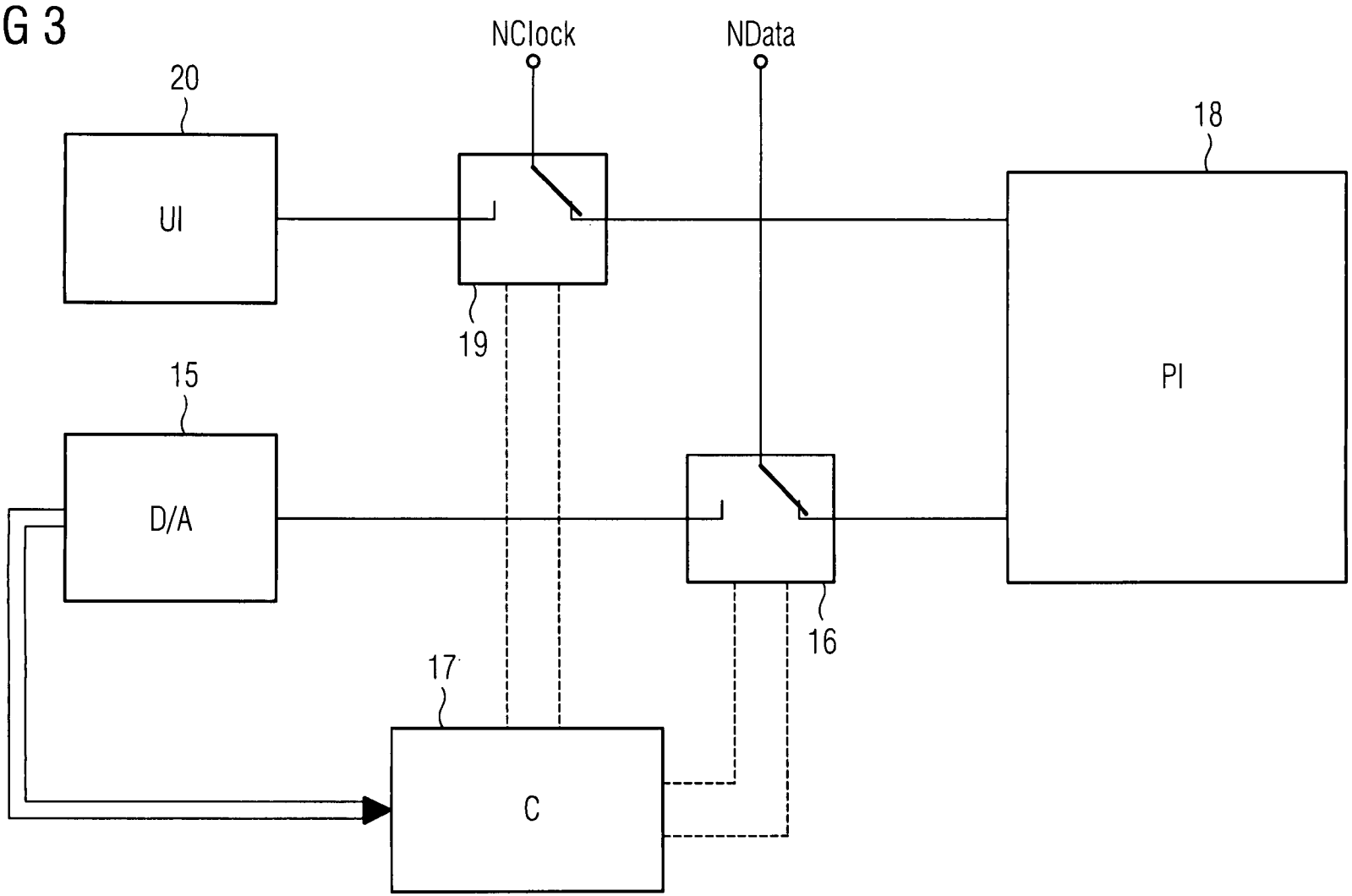
FIG. 3 shows a circuit diagram for wiring a programming socket in accordance with the invention.

Now in order to enable multiple usage of the contacts and/or connections of a programming socket one of the connections, in this case the NData connection or contact 13 of the programming socket, is programmed with a signal that is characteristic of the corresponding usage (function). Further signal processing is then performed in accordance with the characteristic signal. An exemplary circuit diagram for wiring the programming socket is accordingly shown in FIG. 3. On account of the multiple usage, an analog/digital converter 15 cyclically scans the NData input of the programming socket. This takes place symbolically with the aid of a switch 16. Thus at specified intervals the digital/analog converter 15 records the voltage applied at the NData input. The voltage is converted to a digital value and fed to a controller 17 that decides which function the inputs NClock and NData and their downstream signal processing are to have. For example, if there is no data signal or possibly an alternating data signal at the NData input, this input is used as a data input for a programming interface 18 and the switch 16 is correspondingly actuated by the controller 17. Therefore corresponding control wires. (shown as dashed lines in FIG. 3) are provided from the controller 17 to the switch 16.

The controller 17 further controls a second switch 19 in the case of programming so that the synchronization input NClock is fed through to the programming interface 18. This results in the conventional usage of the programming inputs NClock and NData for programming of the hearing device and/or hearing apparatus.

If on the other hand a predetermined voltage e.g. VCC or GND is applied at the NData input, after a certain time this is also registered by the digital/analog converter 15 and reported to the controller 17, which then engages the signal processing system located downstream of the NClock input in another function. In particular in the present example of FIG. 3 the NClock input is switched over from the programming interface 18 to a user interface 20 on the signal processing chip with the aid of the switch 19. This means that the input of the programming interface 18, which in the case of programming acts as a synchronization input, now acts as a signal input for user inputs.

Figure 4:
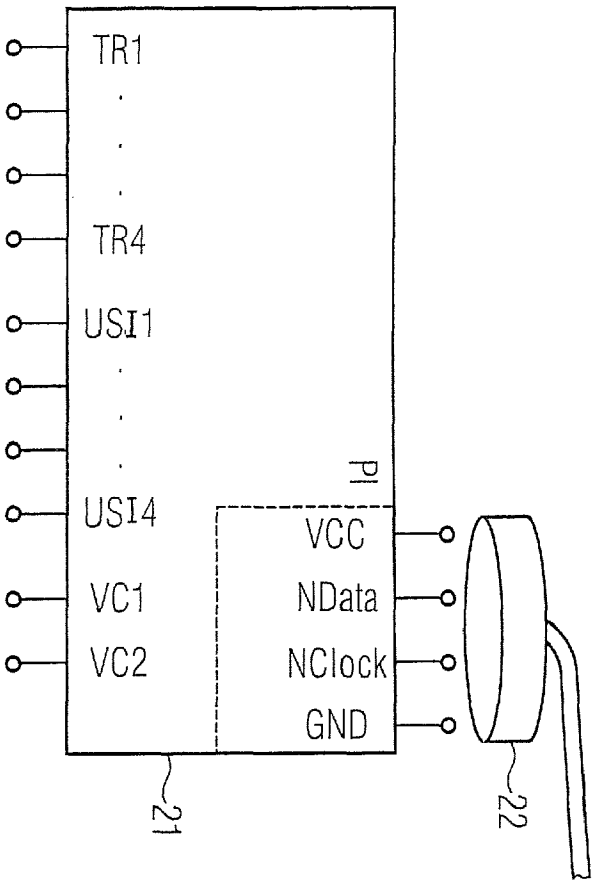
FIG. 4 shows a signal processing chip with an attached programming cable.

FIG. 4 shows a schematic view of a typical signal processing chip 21, here having four signal inputs and/or outputs TR1 to TR4, four user interface inputs USI1 to USI4, and two voltage inputs VC1 and VC2. A programming interface PI having the inputs VCC, NData, NClock and GND is additionally integrated in the signal processing chip 21. A programming plug 22 is plugged onto the programming socket 10 (not shown) (cf. FIG. 2) for programming and thus the inputs of the programming interface PI are used for programming.

According to the present invention the inputs of the signal processing chip, which had originally been provided only for programming, are now also used to record user signals. Therefore in accordance with FIG. 5 a button system 23 is plugged onto the programming socket 10 (not shown) and/or connected to the programming interface. The inputs of the signal processing chip 21' shown in FIG. 5 essentially correspond to the inputs of the signal processing chip 21 shown in FIG. 4.

Figure 5:
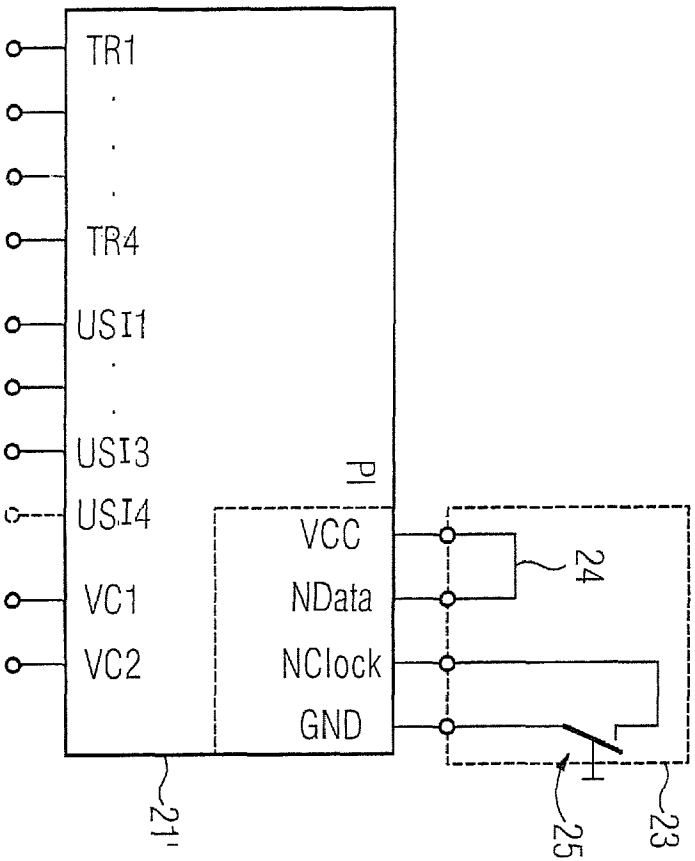
FIG. 5 shows a signal processing chip in which the programming input is used for a user interface.

In the specific example shown in FIG. 5 the button system 23 contains a coupling element 24 by means of which the two inputs VCC and NData are shorted. Thus the NData input (first connection) has a potential that is equal to that at the VCC input (third connection). On account of this predetermined potential of the NData input the next input NClock (second connection) receives a new function, namely that of the signal input for the button system 23. The button system 23 accordingly has a button 25 that is connected here between the connections and/or inputs NClock and GND. When the button 25 is activated the NClock input is set to ground potential. Thus for example a program switching function on a hearing device can be realized with this button 25. Thus the NClock input of the programming interface PI acts as a user signal input. Consequently the need for the user signal input USI4 is obviated, which is therefore indicated with a dashed line in FIG. 5. Thus the signal processing chip 21' can be fitted with fewer pins and can thus be made smaller. Alternatively the "freed-up pin" can be used for an additional signal input.

According to a further alternative the coupling element 24 can be provided for example with an ohmic resistor that may form a potentiometer in conjunction with a further resistor in the signal processing chip 21'. As a result a characteristic voltage, e.g. VCC/2, is present at the NData input. This can be recognized as a unique indication for a specific function of the signal processing system. Depending on the embodiment of the coupling element 24 the NData input can accordingly be set to different potentials. As a function of the various potentials a corresponding number of different functions can then also be provided in signal processing. In this way the programming socket can be used for the most diverse range of user interfaces, which the hearing apparatus and/or hearing device recognizes independently.

The invention claimed is:

1. A hearing apparatus, comprising:

a programming socket that includes a first connection and a second connection;

a signal processing system connected to the second connection; and a control system;

wherein the control system taps the potential of the first connection, wherein the control system engages the signal processing system in a first function when the first connection reaches a predetermined potential and in a second function when the potential of the first connection deviates from the predetermined potential wherein when in the second function, the potential of the second connection fluctuates according to a user input which during a least a portion of the fluctuation the potential of the second connection deviates from the potential of the first connection, and wherein the first function is a programmable function to program the hearing apparatus.

2. The hearing apparatus as claimed in claim 1, wherein the programming socket includes a third connection that is set to a fixed internal potential of the hearing apparatus, and wherein a removable coupling element interconnects the first and third connections, by which the predetermined potential is formed at the first connection by the fixed internal potential.

3. The hearing apparatus as claimed in claim 2, wherein the internal potential is ground or a supply voltage.

4. The hearing apparatus as claimed in claim 2, wherein the coupling element is a simple electrical circuit.

5. The hearing apparatus as claimed in claim 3, wherein the coupling element is a simple electrical circuit.

6. The hearing apparatus as claimed in claim 2, wherein the coupling element comprises an ohmic resistor.

7. The hearing apparatus as claimed in claim 3, wherein the coupling element comprises an ohmic resistor.

8. The hearing apparatus as claimed in claim 1, wherein a button is attached to the second connection to switch a potential of the second connection between two states for user signal input.

9. The hearing apparatus as claimed in claim 2, wherein the second type of plug comprises a button-operated switch in an interconnection between the second connection and a fourth connection in the programming socket, wherein the switch switches an input potential of the second connection to and from a fixed potential of the fourth connection for user signaling input.

10. The hearing apparatus as claimed in claim 9, wherein a button system is mounted on the programming socket and includes the button and the coupling element.

11. The hearing apparatus as claimed in claim 1, wherein the first connection is used for synchronization and the second connection is used for data input when programming the hearing apparatus.

12. The hearing apparatus as claimed in claim 1, wherein the control system determines, via the potential of the first connection, which of two types of plugs, a first or second type, is plugged into the programming socket, and configures the signal processing system to perform either the first function or the second function respectively.

13. The hearing apparatus as claimed in claim 1, wherein an external device is coupled when in the second function.

* * * * *